United States Patent [19]

Luker

[11] 4,360,113

[45] Nov. 23, 1982

[54] CHILD RESISTANT CONTAINER AND CAP ASSEMBLY

[75] Inventor: Edward Luker, Evansville, Ind.

[73] Assignee: Sunbeam Plastics Corporation, Evansville, Ind.

[21] Appl. No.: 284,673

[22] Filed: Jul. 20, 1981

[51] Int. Cl.[3] ..... B65D 55/02

[52] U.S. Cl. ..... 215/216; 215/217; 215/218

[58] Field of Search ..... 215/216, 217, 218

[56] References Cited

U.S. PATENT DOCUMENTS

| | | | |
|---|---|---|---|
| 3,900,123 | 8/1975 | Darlington | 215/216 |
| 3,993,209 | 11/1976 | Julian | 215/216 |
| 4,172,533 | 10/1979 | Montgomery | 215/216 |

*Primary Examiner*—George T. Hall

*Attorney, Agent, or Firm*—Fisher, Gerhardt, Crampton & Groh

[57] ABSTRACT

A child resistant container and cap assembly requiring simultaneous tilting of a lock element in the form of a ring relative to a cap and rotation of the cap relative to the container to disengage complementary lock elements on the ring and container to permit disengagement of threads normally holding the cap in sealed relationship on the neck of a container.

10 Claims, 8 Drawing Figures

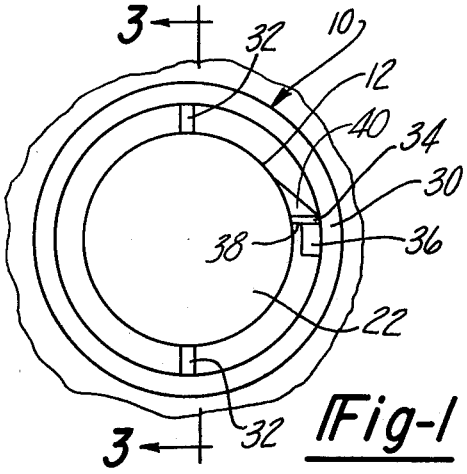
Fig-1
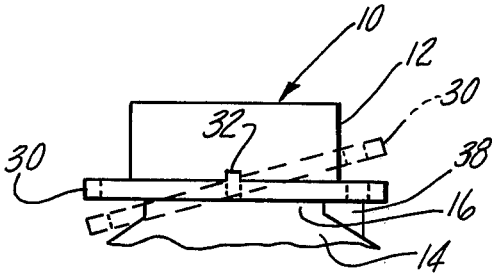
Fig-2
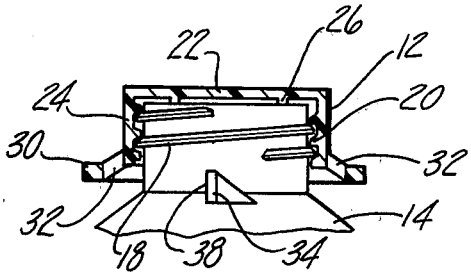
Fig-3
Fig-4
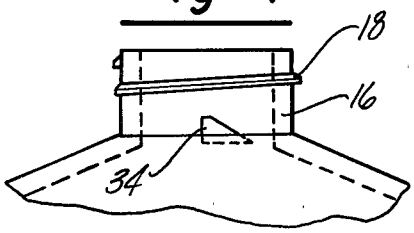
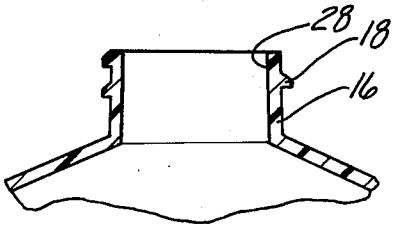
Fig-5
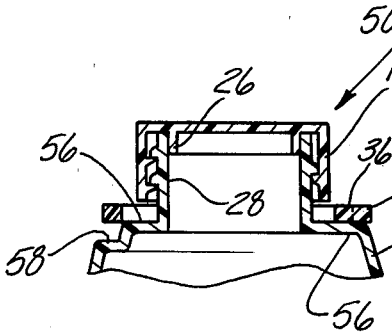
Fig-6
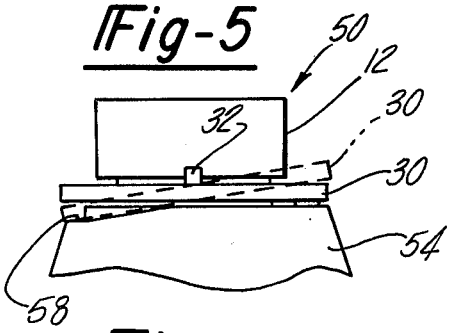
Fig-7
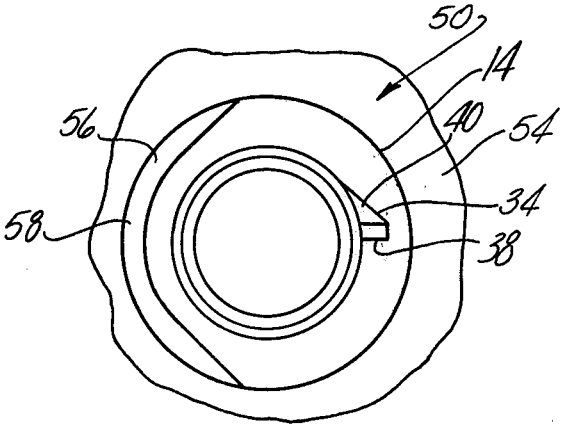
Fig-8

CHILD RESISTANT CONTAINER AND CAP ASSEMBLY

This invention relates to child resistant containers and closures.

A variety of child resistant closures and containers have been developed and to be effective, it has been found desirable that two different motions of different types be necessary in order to effect opening of the closure.

Some of such child resistant closures require pushing or squeezing to distort the closure and bring about unlocking permitting movement to an opening position. Sometimes such pushing or squeezing requires the exertion of a substantial amount of force making opening difficult not only for children but also for infirm or elderly people.

It is an object of this invention to provide a child resistant closure in which there is no need to exert extraordinary force to distort or open the closure.

Another object of the invention is to provide a child resistant container and cap assembly in which two separate and distinct motions are required to bring about opening and one in which the two motions or operations must occur simultaneously.

A further object to the invention is to provide a one piece closure for a container which can be molded as a unit from plastic material.

Still another object of the invention is to provide a closure and container assembly in which the closure can be placed on the container in a conventional manner and with conventional automatic capping machines.

The objects of the invention are accomplished by a child resistant container and cap assembly in which a cap is threadably engaged with threads on a container and in which the cap is provided with a locking ring having a lock element which engages a complementary lock element on the container to prevent the rotational movement in an opening direction necessary to disengage the threads. In order to unlock the cap the ring must be tilted and simultaneously rotated. In one embodiment of the invention such tilting and rotating can be conducted simultaneously until the threads are completely disengaged from each other and in another embodiment of the invention the simultaneous tilting and rotation can only be conducted during the small amount of rotation needed to disengage the complementary lock elements after which the cap can be rotated for one revolution. The number of threads determine the number of unlocking movements required to remove the cap.

The preferred embodiments of the invention are illustrated in the drawings in which:

FIG. 1 is a top view of a closure and container assembly embodying the invention with portions of the container broken away and removed;

FIG. 2 is a side elevation of the container and cap assembly seen in FIG. 1;

FIG. 3 is a view similar to FIG. 2 showing the closure in cross-section;

FIG. 4 is a view of the neck portion of the container with the closure removed;

FIG. 5 is a cross-sectional view of the neck portion seen in FIG. 4;

FIG. 6 is a cross-sectional view of a cap and closure assembly showing another embodiment of the invention;

FIG. 7 is a plan view of the embodiment in FIG. 6; and

FIG. 8 is a top view of the container used with the assembly in FIG. 6.

The child resistant container and cap assembly embodying the invention is designated generally at 10 and includes a closure or cap 12 and a container 14, only a portion of which is shown. The container 14 can be a bottle or other type of container having a neck 16 with threads 18 adapted to threadably engage complementary threads 20 formed within the cap 12.

The cap 12 has a disc-shaped top 22 and a depending annular skirt 24 on which threads 20 are formed. The container 14 is closed by twisting or threading the cap 12 onto the container 14. In closed position, an annular plug seal 26 formed on the underside of the disc-shaped top 22 engages the inner surface 28 in the neck 16. The cap 12 also is provided with a curved lock member 30 which can take the form of a ring disposed concentrically with the axis of the cap 12. The ring or lock member 39 is supported relative to the remainder of the cap 12 by pivot means in the form of a pair of pivot elements 32. The pivot elements 32 are disposed diametrically opposite each other and are formed integrally and as a unit with the ring 30 and cap 12. Both the cap 12 and ring 30 are relatively stiff and the pivot elements 32 permit deflection or tilting of the ring 30 relative to the cap 12 between the positions shown in full and in broken lines in FIG. 2. For this purpose, the cap 12, ring 30 and connecting pivot elements 32 can be molded as a unit of plastic material such as polypropylene or polyethylene.

The container 14 is provided with a lock or cam element 34 which is formed integrally with the neck 16 at its juncture with the remainder of the container 14 and as seen in FIG. 1 extends radially into the space between the ring 30 and the cap 12. The cam element 35 coacts with a stop or complementary lock element 36 formed on the inside diameter of ring 30 which also projects into the space between the neck 16 and ring 30. The cam element 35 has an abutment surface 38 which engages a complementary abutment surface on lock element 36 to limit movement of cap 12 in an opening direction or in a counterclockwise direction as viewed in FIG. 1. The cam element 34 also is provided with a cam surface 40 which engages the lock element 36 when the cap 12 is rotated in a closing or clockwise direction relative to the container 14. During such relative movement the lock element 36 engages the inclined cam surface 40 and causes the ring 30 to be pivoted about the pivot elements 32 until the lock element 36 passes the cam element 34 at which time the ring 30 returns to its initial position. The pivot elements 32 not only permit such tilting of the ring 30 but also act as resilient means to return the ring 30 to its original position.

Upon rotation of the cap 12 relative to the container 14 in a closing direction, the lock element 36 is cammed upwardly together with ring 30 to pass over the complementary lock element 34 until the threads 18 and 20 have been completely tightened to bring the seal 26 into proper relationship to the opening in the neck 16. A limited amount of rotation of cap 12 in an opening direction is permitted from the fully closed condition of the cap until the lock 36 enages the locking face on cam element 34 after which further relative rotation is prevented.

When it is desired to open the container 14 the ring 30 can be depressed at a point diametrically opposite the lock element 36 or the ring 30 can be lifted at a point adjacent the lock elements 36 to tilt the ring 30. With the ring in the tilted position as illustrated in broken line in FIG. 2, the cap 12 and ring 30 are rotated as a unit while the ring 30 is maintained in its tilted position and the threads 18 and 20 are permitted to become disengaged. As soon as the ring 30 is released it will return to its original position relative to the cap 12.

In this manner, a child resistant cap and container assembly are provided in which two separate and simultaneous operations are required to bring about opening of the container 14. In other words, both tilting of the ring 30 and twisting of the cap 12 relative to the container 14 are required.

Another embodiment of the invention is disclosed in FIGS. 6, 7 and 8 in which a cap and container assembly 50 is made up of the cap 12 identical with the one utilized in the assembly 10 and a container 54 is of slightly different configuration than the container 14. As seen in FIG. 8, the container 54 is provided with a shoulder 56 which has a stepped portion 58 diametrically opposite the cam element 34 which can be identical to the cam element in the earlier described embodiment. In the closed condition of the assembly 50 the ring 30 rests on or slightly above the shoulder 56 except in the area of the stepped portion 58. Opening movement of the assembly 50 requires the cap 12 to be oriented to a specific rotational position relative to the container 54 to bring the lock element 36 on the ring 30 into abutment or at least adjacent to the cam element 34. Under those conditions, tilting of the ring 30 raises the lock element 36 to an elevation higher than cam element 34 during which time a portion of the ring 30 will occupy the stepped portion 58. This permits the cap 12 to be twisted a slight amount relative to the container 14 until the lock element 36 passes the cam element 34 in an opening direction. At this point the ring 30 can be released permitting the ring to return to its original position. If more than one revolution is required to remove the cap 12 it must be rotated to bring the complementary lock elements 34 and 36 into engagement again after which the ring 30 must be depressed again into the recess formed by the stepped portion 58 to lift the lock element 36 above the cam element 34 thereby permitting an additional revolution relative to container 14.

In the embodiment of the invention in FIGS. 6 through 8, a child resistant cap and container assembly are provided in that two separate and simultaneous operations, namely, tilting and rotating, are required to bring about unlocking to permit a single rotation of the closure relative to the container 14. Moreover, such tilting and rotation can occur only in one predetermined location of the closure relative to the container. That predetermined location is attained whenever the lock element 36 engages the complementary lock element 34 so that the diametrically opposite portion of the ring 30 is aligned with the step portion 58.

Both of the embodiments of the invention provide a child resistant cap in that two separate and simultaneous operations are required to bring about opening of the closure and container assembly. In both embodiments of the invention, tilting and simultaneous rotation are necessary and in the second embodiment of the invention tilting and rotation can occur in only one relative position of the closure and container, namely the locked position.

The embodiments of the invention in which an exclusive property or privilege is claimed are defined as follows:

1. A child resistant container and cap assembly requiring a twist action of the cap relative to the container to open and close the container, said assembly comprising: a cylindrical cap, a curved lock member extending around the exterior of said cap in spaced relation thereto, pivot means supporting said lock member relative to said cap for limited tilting movement of said lock member from a first to a second position relative to said cap, a pair of abutment elements on said lock member and said container, respectively, engageable with each other to prevent twisting of said cap relative to said container when said ring is in said first position and permitting twisting of said cap relative to said container when said lock member is in said second position.

2. The child resistant container and cap assembly of claim 1 wherein said pivot means yieldably maintains said lock member in said first position.

3. The combination of claim 1 wherein said abutment elements are shaped to engage and move said lock member to said second position in response to twisting of said cap in a closing direction.

4. The combination of claim 3 wherein one of said abutment elements has a cam surface engageable with the other of said abutment elements when said cap is twisted in a closing direction relative to said container.

5. The combination of claim 4 wherein said cam surface is formed on said container.

6. The combination of claim 1 wherein said pivot means include a pair of diametrically spaced pivot portions formed integrally with said cap and with said lock member.

7. The combination of claim 1 wherein said lock member is relatively rigid and is moveable in a substantially undeflected state upon pivoting movement between said first and second positions.

8. The combination of claim 1 wherein said lock member is a ring completely surrounding said cap.

9. The combination of claim 8 wherein said pivot means are disposed diametrically opposite from each other and wherein said abutment element on said ring is disposed midway between said pivot means.

10. The child resistant container and cap assembly of claim 8 wherein said container has a recess diametrically opposite the abutment element on said container for receiving said ring upon tilting movement of the latter.

* * * * *